US006856688B2

(12) United States Patent
Cromer et al.

(10) Patent No.: US 6,856,688 B2
(45) Date of Patent: Feb. 15, 2005

(54) METHOD AND SYSTEM FOR AUTOMATIC RECONFIGURATION OF A MULTI-DIMENSION SOUND SYSTEM

(75) Inventors: Daryl Carvis Cromer, Apex, NC (US); Jan Michael Janick, Morrisville, NC (US); Howard Jeffrey Locker, Cary, NC (US); James Peter Ward, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 831 days.

(21) Appl. No.: 09/844,244

(22) Filed: Apr. 27, 2001

(65) Prior Publication Data

US 2002/0159611 A1 Oct. 31, 2002

(51) Int. Cl.[7] ..... H04R 5/00; H04R 29/00

(52) U.S. Cl. ..... 381/303; 381/58

(58) Field of Search ..... 381/303, 305, 381/300, 307, 58, 59, 23, 101, 102, 103

(56) References Cited

U.S. PATENT DOCUMENTS

| | | | | |
|---|---|---|---|---|
| 3,680,936 | A | | 8/1972 | Backhaus |
| 4,058,675 | A | | 11/1977 | Kobayashi et al. |
| 4,256,922 | A | | 3/1981 | Gorike |
| 4,355,203 | A | | 10/1982 | Cohen |
| 4,472,834 | A | | 9/1984 | Yamamuro et al. |
| 4,524,451 | A | | 6/1985 | Watanabe |
| 4,819,269 | A | | 4/1989 | Klayman |
| 5,386,478 | A | * | 1/1995 | Plunkett ..... 381/103 |
| 5,406,634 | A | | 4/1995 | Anderson et al. |
| 5,581,621 | A | | 12/1996 | Koyama et al. |
| 5,642,422 | A | | 6/1997 | Hon et al. |
| 5,740,253 | A | | 4/1998 | Takeuchi |
| 5,802,194 | A | | 9/1998 | Yamagishi et al. |
| 5,850,453 | A | | 12/1998 | Klayman et al. |
| 5,956,411 | A | | 9/1999 | Edgar |
| 6,002,775 | A | | 12/1999 | Wood et al. |
| 6,035,051 | A | | 3/2000 | Sato |
| 6,118,880 | A | | 9/2000 | Kokkosoulis et al. |
| 6,639,989 | B1 | * | 10/2003 | Zacharov et al. ..... 381/303 |
| 2003/0031333 | A1 | * | 2/2003 | Cohen et al. ..... 381/303 |

FOREIGN PATENT DOCUMENTS

| | | |
|---|---|---|
| JP | 1109899 | 4/1989 |
| JP | 4261300 | 9/1992 |
| JP | 6165297 | 6/1994 |
| JP | 6233377 | 8/1994 |

* cited by examiner

*Primary Examiner*—Stella Woo
(74) *Attorney, Agent, or Firm*—Sawyer Law Group LLP; Carlos Munoz-Bustamante

(57) ABSTRACT

A method and system for reconfiguring a multi-dimension sound system is disclosed. The method and system include a remote control that is capable of emitting a low-frequency sound wave pulse pattern, and a plurality of speakers, wherein each speaker includes a pulse counter that counts a number of sound wave pulses received from the remote control over a predetermined time period. The method and system further include an audio receiver that includes a digital audio encoding system. The receiver uses the respective sound wave pulse count from each of the speakers to compute the distance between the remote control and each speaker, and programs the digital audio encoding system with speaker delay times based on the computed distances.

15 Claims, 3 Drawing Sheets

METHOD AND SYSTEM FOR AUTOMATIC RECONFIGURATION OF A MULTI-DIMENSION SOUND SYSTEM

FIELD OF THE INVENTION

The present invention relates to sound reproduction systems and more particularly to automatic reconfiguration of sound reproduction systems.

BACKGROUND OF THE INVENTION

Current multi-dimension sound systems such as Pro-Logic Surround and Dobly Digital use multiple speakers (5 or more) placed in different spots in a room in order to digitally recreate the effects of true multi-dimensional sound. The sound can be optimized for only one location within the room because the digital system needs to know the exact distance from each speaker to the listener. Information containing the exact distance from each speaker to the listener is used to digitally determine sound delay time periods for each speaker so that the sound information from all speakers reaches the listener simultaneously in order to attain an optimum listening state. Currently information containing the physical distance is entered manually by the listener using a remote control into the system. If the listener is located anywhere else in the room the sound will not optimized. Because the process of manually entering the information is tedious and time consuming, a listener will typically only configure the system for one location in the room and not re-configure the system when the listener is in a different location.

Accordingly, what is needed is a system and method for autoconfiguration of a sound system without the listener having to continually enter data for each new position. The present invention addresses such a need.

SUMMARY OF THE INVENTION

The present invention provides a method and system for reconfiguring a multi-dimension sound system. The method and system include a remote control that is capable of emitting a low-frequency sound wave pulse pattern, and a plurality of speakers, wherein each speaker includes a pulse counter that counts the number of sound wave pulses received from the remote control over a predetermined time period. The method and system further include an audio receiver that includes a digital audio encoding system for generating the multi-dimensional sound. The receiver uses the respective sound wave pulse count from each of the speakers to compute the distance between the remote control and each speaker, and programs the digital audio encoding system with speaker delay times based on the computed distances.

According to the present invention, the method and system for automatically configuring timing delays for a multi-dimension sound system is both low-cost and highly accurate. The system is low cost because the speakers only need to be modified with logic for capturing and digitizing the sound wave from the remote control. The system is highly accurate because the ratio between the travel speed of low-frequency sound waves and the sampling rate of the pulse counter ensures that the distance between the remote control and each of the speakers is measured accurately.

DETAILED DESCRIPTION

The present invention relates to sound reproduction systems and more particularly to automatic reconfiguration of sound reproduction systems. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

A sound system in accordance with the present invention can be configured to automatically measure the distance between the listener and each speaker, and then to arrange for the time delays appropriate for each speaker according to the data resulting from the measured distances.

Figure 1:
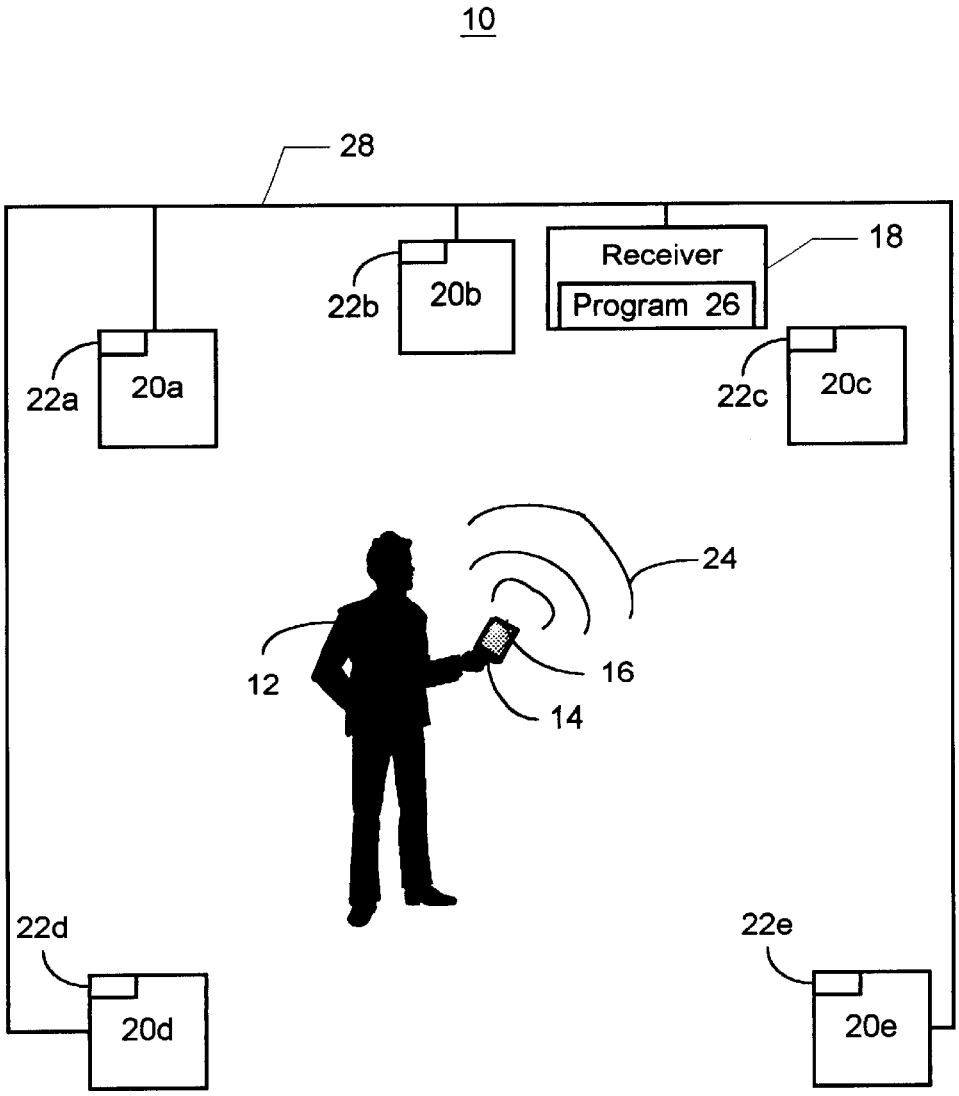
FIG. 1 illustrates a multi-dimension sound system for use in accordance with the present invention.

FIG. 1 illustrates a multi-dimension sound system for use in accordance with the present invention. The sound system 10 comprises an audio receiver 18 and a plurality of speakers 20*a*–20*e* (collectively referred to as speakers 20) coupled to the receiver 18. The receiver 18 can be controlled by a remote control 16 and includes a conventional microprocessor (not shown) for controlling a digital audio encoding system, such as Dolby Pro Logic, Dolby Digital, Digital Theater Sound (DTS), and THX. In a preferred embodiment, the receiver 18 communicates with the speakers 20 via a digital interconnect format 28, such as S/PDIF (IEC60958), which is capable of carrying both audio and datastreams. Thus, both the receiver 18 and the speakers 20 are equipped with S/PDIF digital input and output.

In one preferred embodiment, the automatic reconfiguration process is enabled by modifying the components of the sound system 10. The modifications include providing the remote control 16 with a configuration button 14 that a user 12 presses to initiate the automatic reconfiguration process. The remote control 18 also includes logic to emit a low-frequency sound wave pulse pattern 24. Each speaker 20 is provided with a pulse counter 22 that includes logic for capturing and digitizing the wave pulses 24 and for counting the number of wave pulses 24 received.

The receiver 18 is provided with an auto-configuration program 26 that runs on the microprocessor. In accordance with the present invention, the auto-configuration program 26 functions to send out start and stop commands 28 that instruct the speakers 20 to count the wave pulses 24 emitted by the remote control 16. The program 26 also collects the wave pulse counts from the speakers 20, computes the distance between each speaker 20 and the remote control 16 based on the respective pulse counts, and further programs the digital audio encoding system with appropriate speaker delay times based on the computed distances.

Figure 2:
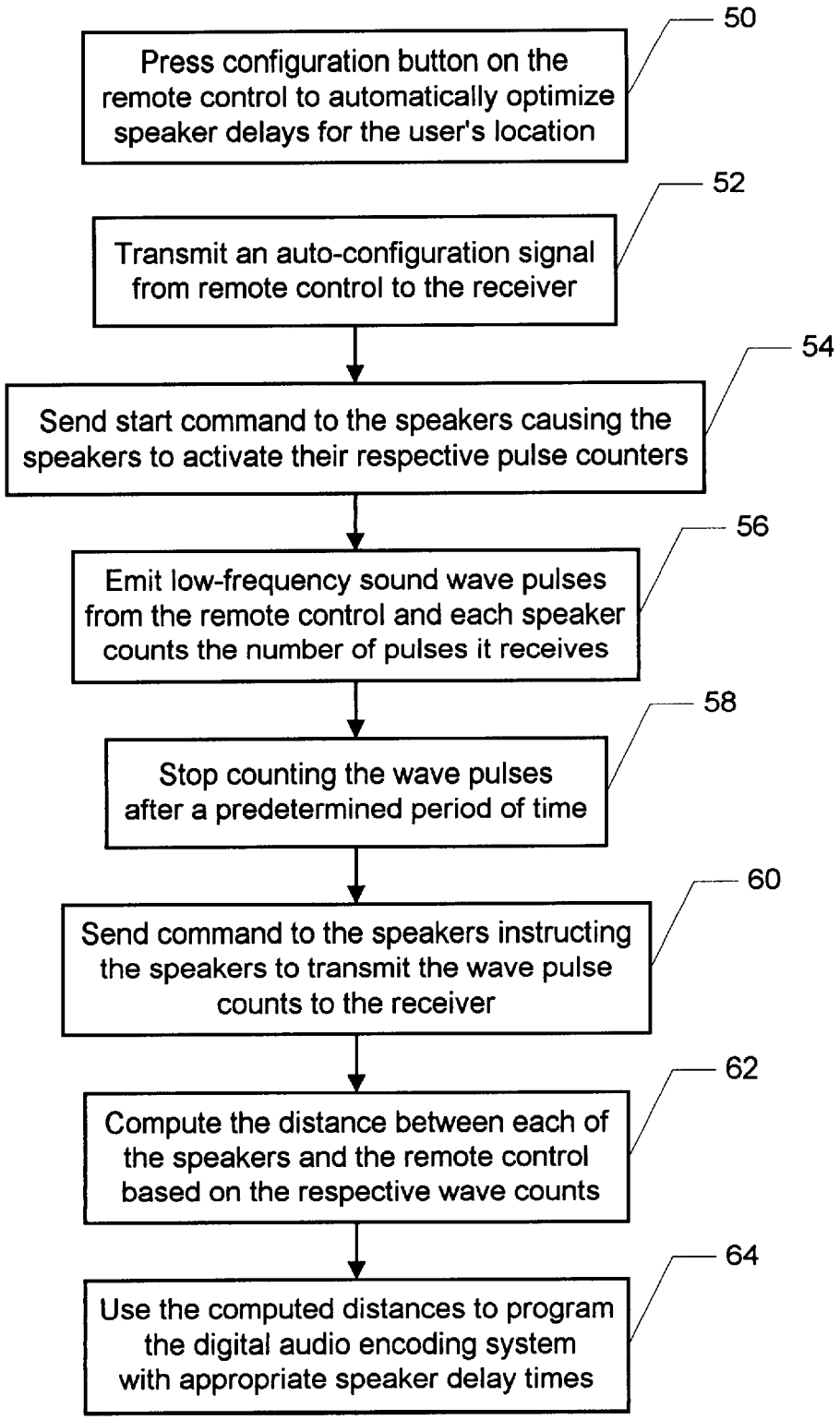
FIG. 2 is a flow chart illustrating the auto reconfiguration process in a preferred embodiment of the present invention.

FIG. 2 is a flow chart illustrating the auto reconfiguration process in a preferred embodiment of the present invention. The process begins when a user 12 positioned at a particular listening location presses the configuration button 14 on the remote control 16 to automatically optimize speaker delays for the user's location in step 50. The remote control 16 then transmits an auto-configuration signal to the receiver 18 in step 52. In response, the receiver 18 sends a start command to the speakers 20 causing the speakers to activate their respective pulse counters 22 in step 54.

After an appropriate delay from transmitting the auto-configuration signal, the remote control 16 begins emitting low-frequency sound wave pulses 24 and each speaker 20 begins counting the number of pulses it receives in step 56. In a preferred embodiment, the pulse travels at a 1000 Hz rate where each pulse is equal to 6 inches of distance. After a predetermined time, the pulse counters 22 stop counting the wave pulses 24 in step 58. In a preferred embodiment, the receiver 18 sends a stop command over the digital audio channel to the speakers 20 that deactivates the pulse counters 22. Since the digital command 24 travels much faster than the 1000 Hz rate the pulse counters 22*a*–22*e* will turn off before the next pulse reaches them. Because each pulse counter 22*a*–22*e* only counts during the same time interval, the speakers 20 which are close to the remote control 16 will receive more pulses, because the first pulse arrives sooner. After the pulse counters 22 are deactivated, the receiver 18 sends another command to the speakers 20 instructing each speaker 20 to transmit the wave pulse count from the pulse counter 22 back to the receiver 18 in step 60.

From the pulse counts, the receiver 18 computes the distance between each of the speakers 20 and the remote control 18 (and therefore the user 12) based on the respective wave counts in step 62. The receiver 18 also uses the computed distances to program the digital audio encoding system with appropriate speaker delay times instep 64.

For example, if speaker 20*a* received 4 more pulses than speaker 20*c*, then speaker 20*a* is located 2 feet closer to the listener 12. The number of wave pulses counted is then used by the receiver 18 to set the correct delay times for each speaker 20. Although the current invention is described in terms of a system of 5 speakers, the process described by this invention could be utilized with any number of speakers.

In the first embodiment of the present invention as described above, sound is utilized as the pulse medium. However, any wave technology that travels slow enough relative to the sampling within the speakers can be utilized. The ratio needs to be at least 100-to-1 so that distances can be measured in 6-inch increments.

Figure 3:
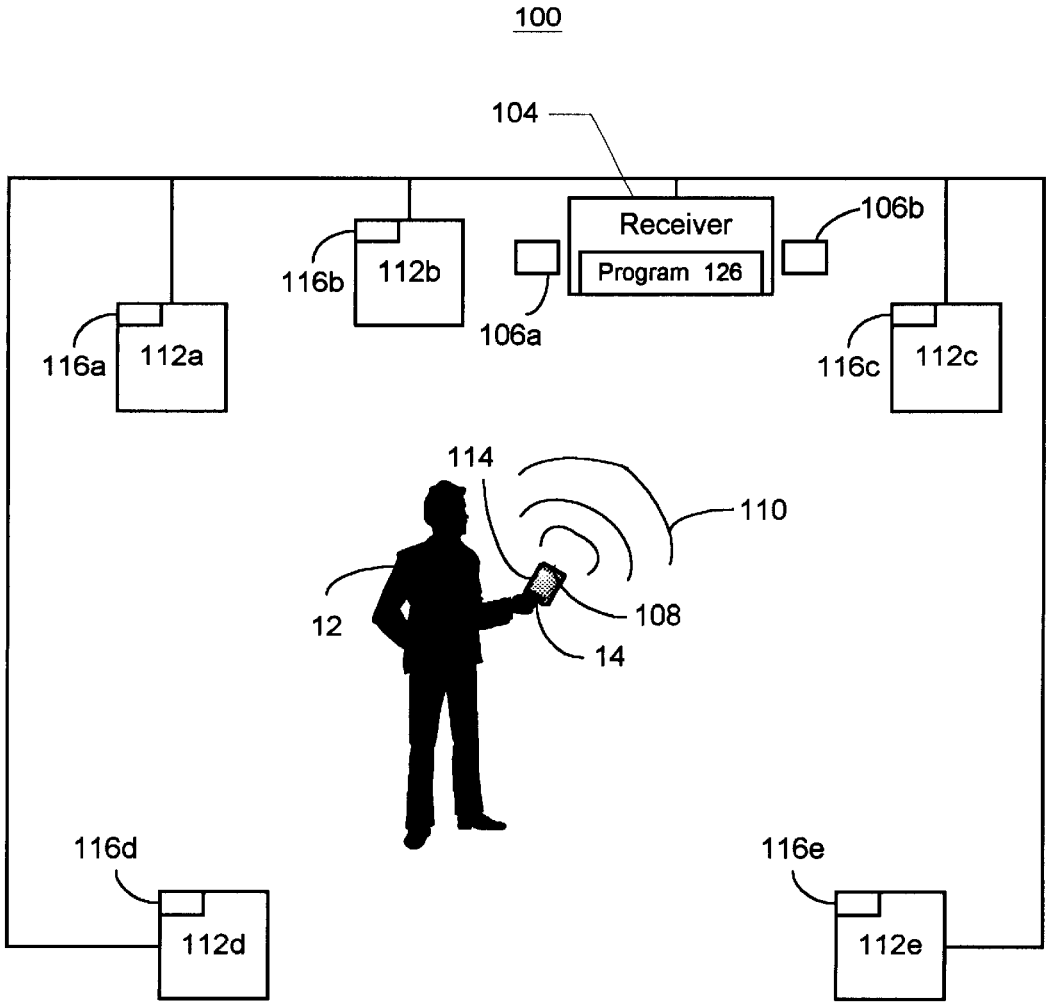
FIG. 3 is a diagram illustrating the multi-dimension sound system in a second preferred embodiment.

FIG. 3 is a diagram illustrating the multi-dimension sound system in a second preferred embodiment, where like components have like reference numerals. The second embodiment of the multi-dimension sound system 100 is lower in cost than the first embodiment and uses radio frequency (RF) waves, rather than low-frequency sound waves. The multi-dimension sound system 100 uses a triangulation, which is an operation for finding a position or location by means of bearings from two fixed points that are a known distance apart. The multi-dimension sound system 100 provides the remote control 108 a with radio transceiver 114, provides each of the speakers 112*a*–*e* with a radio transceiver 116*a*–*e*, and provides the audio receiver 104 with two fixed transceiver modules 106*a*–106*b* (collectively 106) for this purpose. As is well-known in the art, a transceiver is a device capable of transmitting and receiving analog or digital signals. The fixed transceiver modules 106 are coupled to the audio receiver 104 and spaced at least 12 inches apart. The receiver modules 106 are preferably placed on each side of the audio receiver 18.

The second embodiment uses triangulation technology that requires the user 12 to manually configure the system the first time by standing a predetermined distance from the receiver modules 106 while holding the remote control 108. In a preferred embodiment, the predetermined distance is 10 feet from the audio receiver 18.

To manually configure the system upon first use, the user 12 presses the configuration button 14 on the remote control 108 that causes the transceiver 114 on remote control 108 to transmit a radio wave 110 that is received by the speaker transceivers 116 and the transceiver modules 106. The speaker transceivers 116 and the transceiver modules 106 then respond by transmitting their own unique radio wave. The transceiver 114 on the remote control receives these unique radio waves, and the remote control associates each radio wave with the correct source and records the time delay between the receipt of the radio waves.

After the user 12 presses the configuration button 14 on the remote control 108, the user manually enters into the audio receiver 104 the distance from the remote control 108 to each speaker 112*a*–*e*. As is well-known, the user 12 may enter the distance measurements directly into the user interface of the audio receiver 104 or through the remote control 108.

The audio receiver 104 then reports these distances to the remote control 108, which then associates the distance of each speaker 112 with its recorded time delay. The sound system 100 is now calibrated to perform triangulation because the remote control 108 knows the amount of time it takes for each radio wave from each speaker 112 to reach the remote control 108 and the distance of each speaker 112 when the remote control 108 is located at the predetermined configuration location.

After the sound system 100 is calibrated, the user 12 may change locations with the remote control 12 and have the sound system 100 automatically reconfigure itself for the change of position. When the user 12 presses the configuration button 14 on remote control 108, the remote control 108 transmits the radio wave 110. In response, the transceivers 116 on the speakers 112 and the transceiver modules 106 transmit their unique radio waves, which are typically received by the remote control 108 at different times. Through triangulation, the remote control 108 can then determine the new position of the user 12 based on the time delays. The remote control 106 compares the time delays associated with each speaker 112 to the time delay associated with each speaker when the remote control 106 is located at the known configuration position. From this comparison, the remote-control 108 recalculates the distance from the user 12 to each speaker 112*a*–*e*. The remote control 108 then reports these distances to the audio receiver 104, which then uses the new distances to program the correct delays for the digital audio encoding system.

A method and system for automatic reconfiguration of a multi-dimension sound system has been disclosed. According to the present invention, a user may move to any location within the listening space and use the remote control to instruct the sound system to automatically adjust time delays appropriately for all speakers by merely pressing a configuration button on the remote control.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A multi-dimension sound system, comprising:

a remote control having a button that initiates an automatic configuration process such that the remote control begins emitting a low-frequency sound wave pulse pattern; and a plurality of speakers, wherein each speaker includes a pulse counter that counts a number of sound wave pulses received from the remote control over a predetermined time period; and an audio receiver coupled to the speakers, the audio receiver including a digital audio encoding system, wherein the receiver uses the respective sound wave pulse count from each of the speakers to compute the distance between the remote control and each speaker, and programs the digital audio encoding system with speaker delay times based on the computed distances.

2. The system of claim 1 wherein the receiver and the speakers communicate via a digital interconnect format.

3. The system of claim 2 wherein the audio receiver includes a microprocessor for controlling the digital audio encoding system.

4. The system of claim 3 wherein the receiver further includes an auto-configuration program that runs on the microprocessor that functions to send out start and stop commands over the interconnect format that control when the speakers count the sound wave pulses emitted by the remote control.

5. The system of claim 4 wherein the sound wave pulses travel at a 1000 Hz rate where each pulse is equal to 6 inches of distance.

6. The system of claim 5 wherein a ratio between a travel speed of the sound wave and a sampling rate of the speakers is at least 100-to-1.

7. The system of claim 6 wherein the interconnect format comprises S/PDIF.

8. The system of claim 7 wherein the digital audio encoding system comprises at least one Dolby Pro Logic, Dolby Digital, Digital Theater Sound (DTS), and THX.

9. A method for automatic reconfiguration of a sound system, comprising the steps of:

(a) transmitting sound wave pulses from a remote control to a plurality of speakers, each speaker containing a pulse counter;

(b) counting the sound wave pulses by each of the pulse counters over a predetermined period of time, each of the pulse counters maintaining a respective sound wave pulse count;

(c) transmitting the sound wave pulse counts from the speakers to an audio receiver via a digital interconnect format;

(d) computing the distance between each of the speakers and the remote control based on the respective sound wave counts; and (e) using the computed distances to program a digital audio encoding system with appropriate speaker delay times.

10. The method of claim 9 wherein step (a) further includes the steps of:

(i) transmitting an auto-configuration signal from a remote control to the audio receiver in response to a user pressing a configuration button on the remote control;

(ii) sending a start command from the audio receiver to each of the speakers via the digital interconnect format causing the speakers to activate their respective pulse counters; and (iii) emitting low-frequency sound wave pulses from the remote control to the speakers.

11. The method of claim 10 wherein step (b) further includes the step of:

(i) sending a stop command from the audio receiver to each of the speakers that deactivates the pulse counters.

12. The method of claim 11 wherein step (a)(iii) further includes the step of:

(1) transmitting the sound wave pulse at a rate of 1000 Hz, such that each pulse is equal to six inches of distance.

13. The method of claim 12 wherein step (c) further includes the step of:

(i) sending another command from the audio receiver to the speakers instructing each speaker to transmit the sound wave pulse count from the pulse counter back to the audio receiver.

14. The method of claim 13 further including the step of: providing a ratio between a travel speed of the sound wave pulse and a sampling rate of the speakers of at least 100-to-1.

15. A triangulating multi-dimension sound system, comprising:

a plurality of speakers, each speaker having a radio transceiver that emits a unique radio wave for the speaker;

two transceiver modules spaced apart, each emitting a unique radio wave;

a remote control having a radio transceiver and a configuration button for initiating a configuration process in which the remote control emits a radio wave that causes each speaker transceiver and the transceiver modules to emit the unique radio wave; and an audio receiver coupled to the speakers and two the two receiver modules, the audio receiver including a digital audio encoding system, wherein during a manual configuration process, a user holds the remote control a predetermined distance from the receiver modules and presses the configuration button causing the speakers to transmit their respective radio waves, the remote control associating each radio wave with the corresponding speaker and records a time delay between receipt of the radio waves, and the audio receiver reporting the distances input by the user to the remote control to calibrate the system, and during an automatic configuration process, the user moves to a new position, the transceivers on the speakers and the remote modules transmit their unique radio waves, the remote control then compares the time delays associated with each speaker to the time delay associated with each speaker when the remote control is located at the known configuration position, and recalculates the distance from the user to each speaker, the remote control then reports the distances to the audio receiver, which then uses the new distances to program the correct delays for the digital audio encoding system.

* * * * *